US011000111B2

(12) United States Patent
Sabbagh

(10) Patent No.: US 11,000,111 B2
(45) Date of Patent: May 11, 2021

(54) TANDEM HAMMOCK SYSTEM AND METHOD

(71) Applicant: Snow Joe LLC, Carlstadt, NJ (US)

(72) Inventor: Victor Sabbagh, Brooklyn, NY (US)

(73) Assignee: Snow Joe, LLC, Carlstadt, NJ (US)

( * ) Notice: Subject to any disclaimer, the term of this patent is extended or adjusted under 35 U.S.C. 154(b) by 0 days.

(21) Appl. No.: 16/531,738

(22) Filed: Aug. 5, 2019

(65) Prior Publication Data

US 2020/0046107 A1 Feb. 13, 2020

Related U.S. Application Data

(60) Provisional application No. 62/715,362, filed on Aug. 7, 2018.

(51) Int. Cl.
*A45F 3/24* (2006.01)

(52) U.S. Cl.
CPC ..... *A45F 3/24* (2013.01)

(58) Field of Classification Search
CPC ..... A45F 3/22; A45F 3/24
See application file for complete search history.

(56) References Cited

U.S. PATENT DOCUMENTS 273,388 A * 3/1883 Pratt ..... A45F 3/22 5/122
700,978 A * 5/1902 Palmer ..... A45F 3/22 5/122
D829,455 S * 10/2018 Sabbagh ..... D6/347
2009/0265851 A1* 10/2009 Clark ..... A45F 3/22 5/122
2018/0049540 A1* 2/2018 Stapf ..... A45F 3/24
2020/0046107 A1* 2/2020 Sabbagh ..... A45F 3/22

* cited by examiner

*Primary Examiner* — Eric J Kurilla
(74) *Attorney, Agent, or Firm* — Seyfarth Shaw LLP; Brian Michaelis

(57) ABSTRACT

A tandem hammock assembly having a plurality of hammocks coupled to one another by at least two straps, each of the at least two straps being fastened to respective ends of the plurality of hammocks; and at least two elongate bars each having two fastening elements on respective ends, the fastening elements being adapted to detachably fasten to respective ones of the at least two straps and the at least two strap each being adapted to be detachably fixed to a respective anchoring structure.

6 Claims, 9 Drawing Sheets

STEP4
(completion)

TANDEM HAMMOCK SYSTEM AND METHOD

CROSS-REFERENCE TO RELATED APPLICATION

The present application claims the benefit of and priority to U.S. Provisional Patent Application No. 62/715,362, filed on Aug. 7, 2018, the entire contents of which are incorporated by reference herein.

FIELD OF THE INVENTION

The invention relates to the field of hammocks, more specifically to a system and method for hanging two or more hammocks in a side-by-side configuration.

BACKGROUND OF THE INVENTION

Hammocks are often used for leisure and as a temporary resting platform by hikers and campers. A single hammock is typically hung between two trees (or other sturdy posts). Single-person and two-person hammocks are available. However, sharing a hammock between two people can be uncomfortable, particularly for an extended amount of time. As such, there is a need for suspending two hammocks in a side-by-side configuration. Such a suspension system would be particularly useful if only two trees in close proximately are available. It would also allow two individuals to remain near one another, without the disadvantages of a two-person hammock.

SUMMARY OF THE INVENTION

The invention relates to a system and method for suspending two hammocks in a tandem configuration. The system may include: two hammocks, two suspension straps with related hardware, and two tandem hammock bars. The tandem hammock bars maintain a fixed distance between the two hammocks, such that the two hammocks remain in a safe and comfortable position relative to one another.

According to an exemplary embodiment of the invention, a tandem hammock assembly comprises a plurality of hammocks coupled to one another by at least two straps, each of the at least two straps being fastened to respective ends of the plurality of hammocks; and at least two elongate bars each comprising two fastening elements on respective ends, the fastening elements being adapted to detachably fasten to respective ones of the at least two straps, wherein the at least two straps are each adapted to be detachably fixed to a respective anchoring structure.

According to an embodiment of the invention, the at least two elongate bars are equal in length.

According to an embodiment of the invention, each of the two elongate bars comprises a plurality of sections that are detachable from one another and the two fastening elements.

According to an embodiment of the invention, the two fastening elements are tethered to each other by an elastic rope.

According to an embodiment of the invention, each of the at least two straps comprises a plurality of strap loops that are evenly spaced apart along a length of each strap.

According to an embodiment of the invention, each of the at least two straps is detachably fastened to one of the respective ends of the plurality of hammocks by forming a loop through a hammock end loop on the one of the respective ends of the plurality of hammocks and detachably fastening two adjacent ones of the plurality strap loops together.

According to an embodiment of the invention, one of the fastening elements is detachably fixed to another one of the plurality of strap loops that is adjacent to one of the two fastened adjacent strap loops

BRIEF DESCRIPTION OF THE DRAWINGS

Exemplary embodiments of the present disclosure will be described with references to the accompanying figures, wherein.

DETAILED DESCRIPTION OF THE INVENTION

Figure 1:
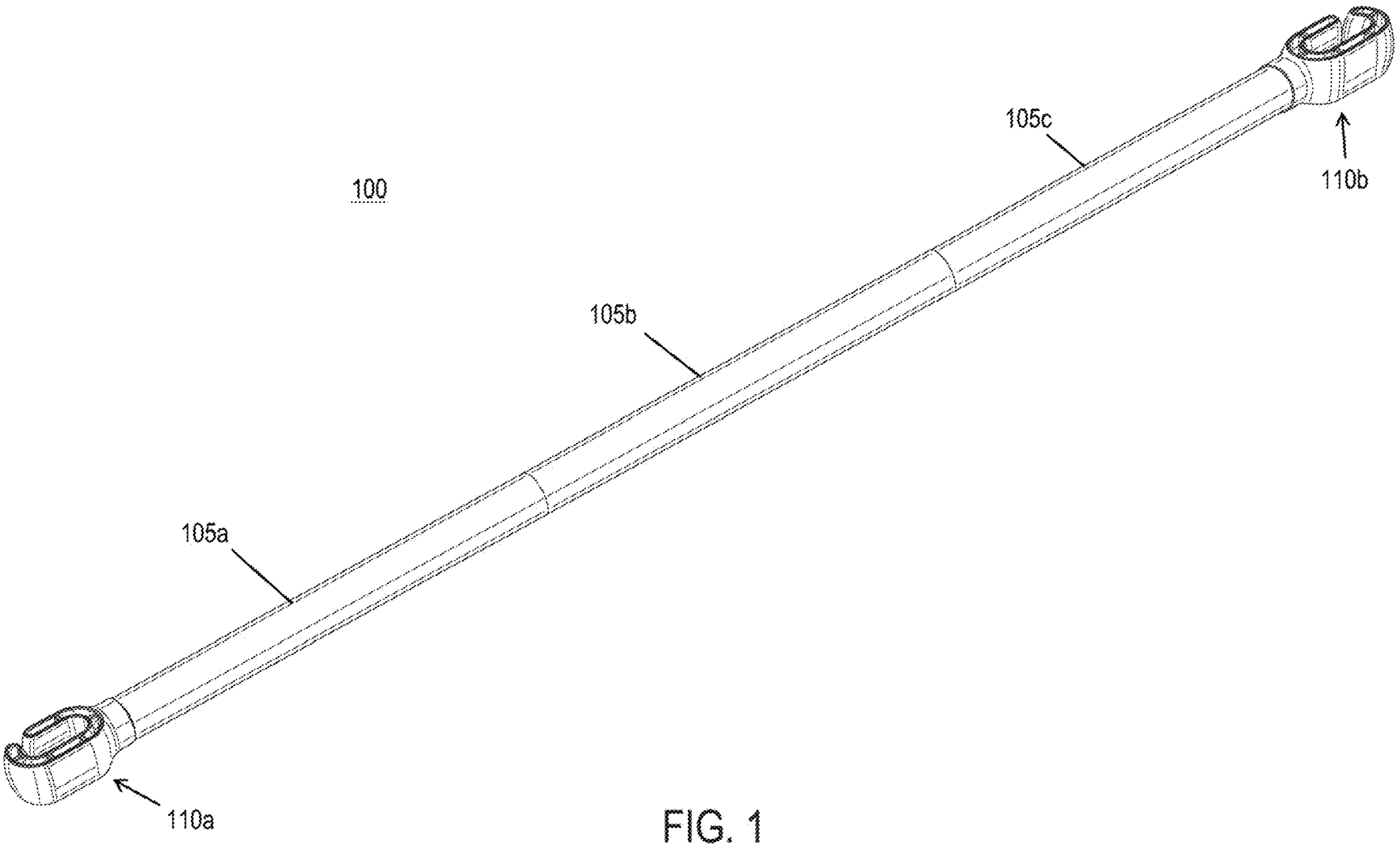
FIG. 1 is a perspective view of an embodiment of a tandem hammock bar for use with the disclosed tandem hammock system and method.

Embodiments of the present invention will now be described with reference to the above-identified Drawings. However, the Drawings and the description herein of the invention are not intended to limit the scope of the invention. It will be understood that various modifications of the present description of the invention are possible without departing from the spirit of the invention. Also, features described herein may be omitted, additional features may be included, and/or features described herein may be combined in a manner different from the specific combinations recited herein, all without departing from the spirit of the invention.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

Figure 5:
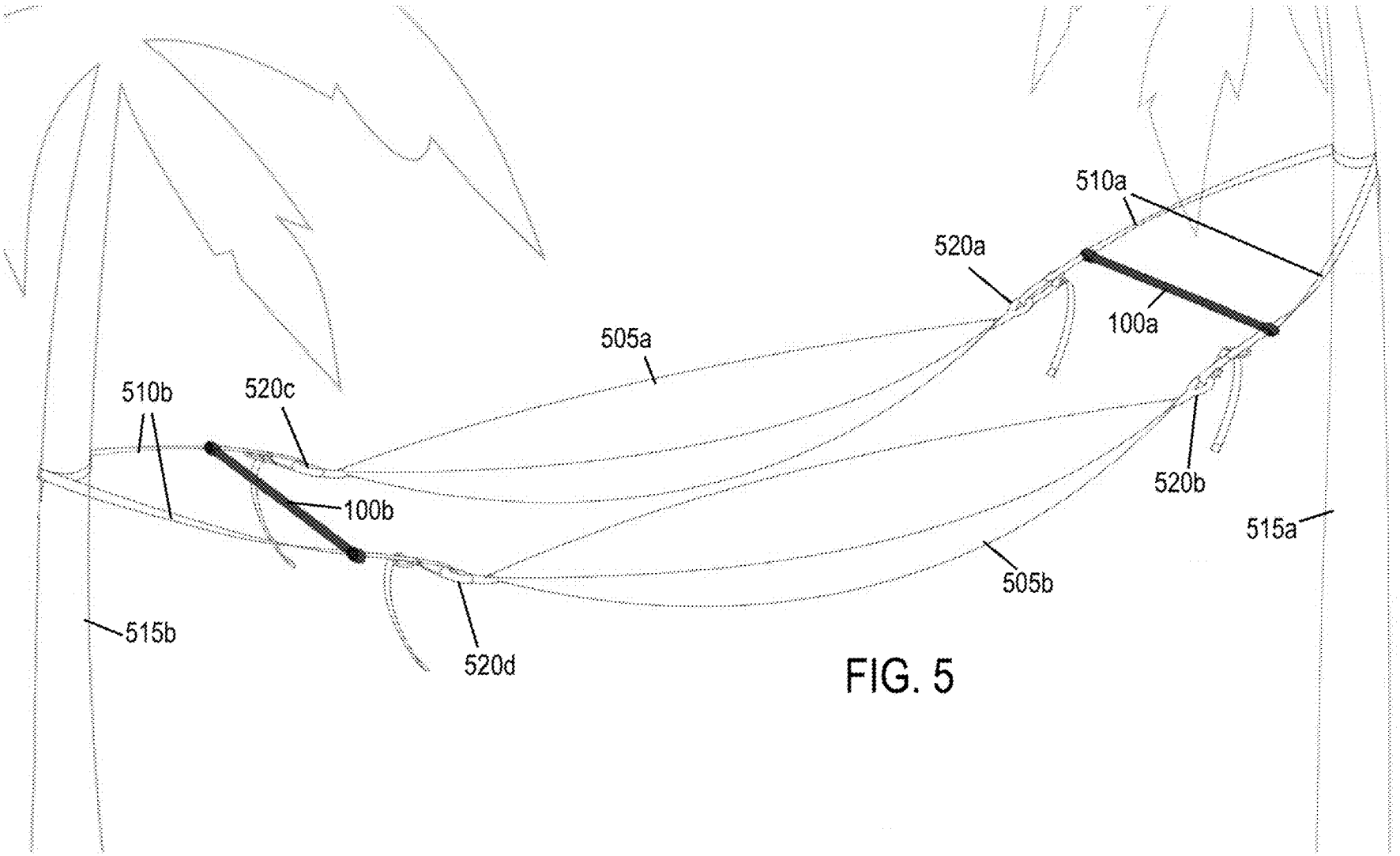
FIG. 5 is a perspective view of an embodiment of the tandem hammock system.

Disclosed is a tandem hammock system and related method for hanging two or more hammocks in a side-by-side configuration. As shown in FIG. 5, in one embodiment, the system is comprised of: two single-person hammocks 505*a* and 505*b*, two elongate bars 100*a* and 100*b*, and two hammock suspension straps 510*a* and 510*b*, which tether the hammocks 505*a* and 505*b* to a pair of trees 515*a* and 515*b* that serve as anchoring structures. In embodiments, alternative anchoring structures, such as posts, stands, and the like, may be used. FIG. 5 illustrates two (2) hammocks 505*a* and 505*b* that are the same in configuration and size. In embodiments, other numbers of hammocks of various configurations may be used. According to an exemplary embodiment of the invention, hammocks 505*a* and 505*b* are tethered to trees 515*a* and 515*b* with sufficient tension such that hammocks 505*a* and 505*b* can each receive the body weight of a user without dropping down excessively. Suspension straps 510*a* and 510*b* may be made with a polymeric material, such a nylon and the like, with sufficient friction to hold up the body weight of two or more users in respective hammocks 505*a* and 505*b* without sliding down trees 515*a* and 515*b*. According to an exemplary embodiment of the invention, suspension straps 510*a* and 510*b* are each a wrapped around trees 515*a* and 515*b* a plurality times for the aforementioned friction, with respective ends thereof fastened to hammocks 505*a* and 505*b* as described in further detail below. In embodiments, suspension straps 510*a* and 510*b* may each be embodied by plural straps that each separately fasten to hammocks 505*a* and 505*b* on one end and wrap around trees 515*a* and 515*b* on the other end. As shown in FIG. 5, suspension straps 510*a* and 510*b* are fastened to hammocks 505*a* and 505*b* via loops 520*a*, 520*b*, 520*c*, and 520*d* on respective ends of hammocks 505*a* and 505*b*. And hammocks 505*a* and 505*b* are held with tension and separated from each other by bars 100*a* and 100*b*. According to an exemplary embodiment of the invention, bars 100*a* and 100*b* are of equal length. Accordingly, hammocks 505*a* and 505*b* are aligned substantially in parallel with each other by bars 100*a* and 100*b*. According to an exemplary embodiment of the invention, bars 100*a* and 100*b* are collapsible for storage, as described in further detail below. In embodiments, bars 100*a* and 100*b*, and/or one or more additional bars, may have differing lengths for different arrangements of hammocks 505*a* and 505*b*, and any additional hammocks.

Referring now to FIG. 1, collapsible bar 100 according to an exemplary embodiment of the invention is described. As shown in FIG. 1, collapsible bar 100 includes three (3) cylindrical sections 105*a*, 105*b*, and 105*c* that are joined together end-to-end to form a rigid member for use as bars 100*a* and 100*b* shown in FIG. 5 and described above. In embodiments, sections 105*a*, 105*b*, and 105*c* may be made from a metal, a polymeric material, or any materials that can provide sufficient mechanical strength and rigidity—in a cylindrical shape, substantially prism shape, and the like—to separate and align hammocks 505*a* and 505*b*. Collapsible bar 100 also includes two fastening elements 110*a* and 110*b* at respective ends for fastening to suspension straps 510*a* and 510*b*. As illustrated in FIG. 1, fastening elements 110*a* and 110*b* are formed by loop hook and gate structures, which are similar to carabiners in shape, made from a resilient polymeric material. In embodiments, fastening elements 110*a* and 110*b* may be formed by other shapes for releasably fastening bar 100 to suspension straps 510*a* and 510*b*.

Figure 2:
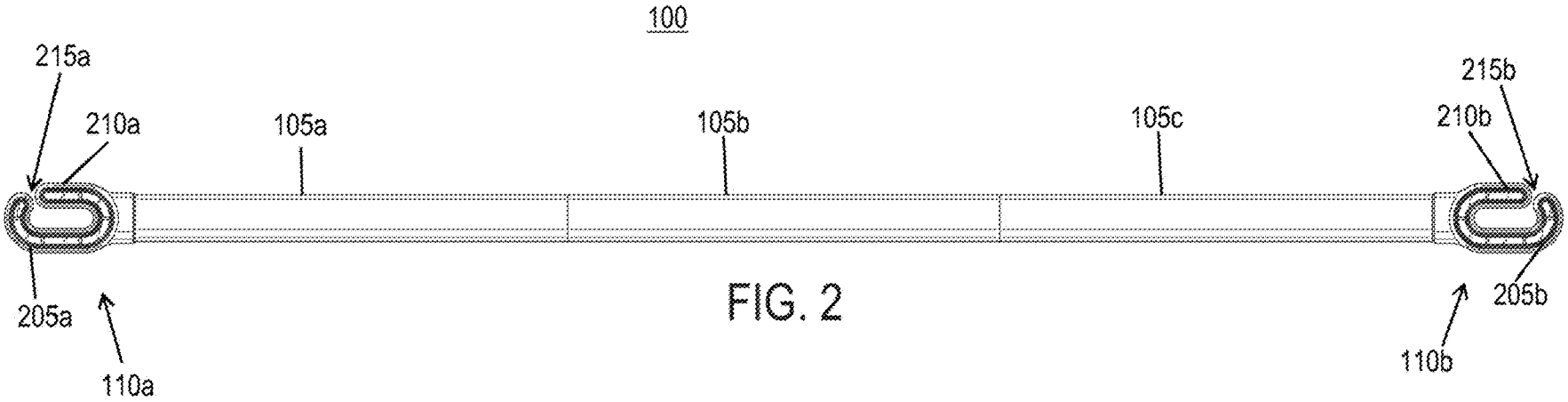
FIG. 2 is a side view of the tandem hammock bar of FIG. 1.

FIG. 2 is a side view of bar 100 to more clearly illustrate the loop hook and gate structure of fastening elements 110*a* and 110*b*. As shown in FIG. 2, each fastening element 110 (*a* and *b*) includes a loop hook section 205 (*a* and *b*) and a gate section 210 (*a* and *b*). These sections may be formed by an integrated loop of the aforementioned resilient polymeric material incorporating an opening 215 (*a* and *b*). Operatively, gate sections 210*a* and 210*b* may be pushed inward by a user for inserting suspension straps 510*a* and 510*b* and pushed outward for releasing inserted suspension straps 510*a* and 510*b*.

Figure 3:
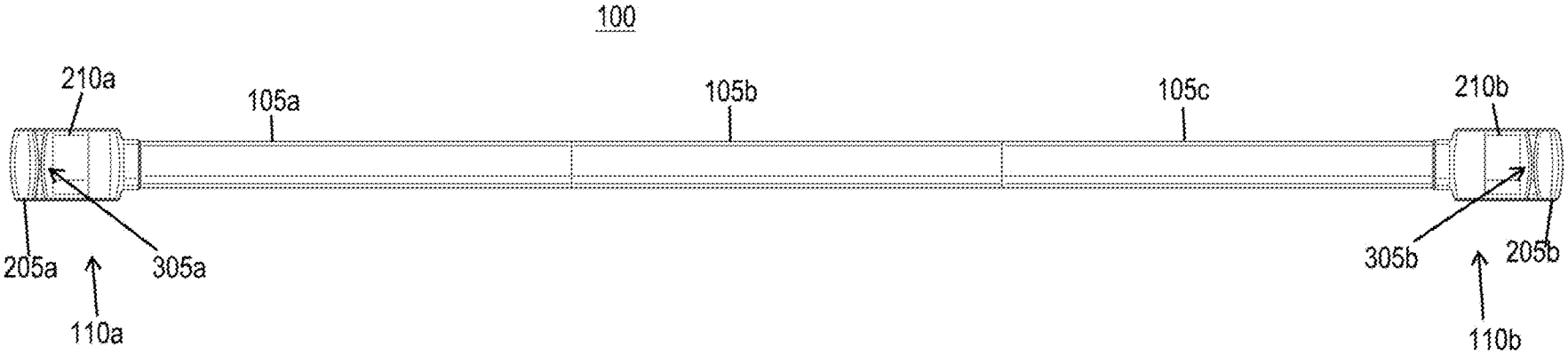
FIG. 3 is a bottom view of the tandem hammock bar of FIG. 1.

Referring now to FIG. 3, which is a bottom view of bar 100, loop hook sections 205*a* and 205*b* and gate sections 210*a* and 210*b* incorporate respective curved ends that meet one another at respective tips such that they form closures 305*a* and 305*b* that would prevent an inserted suspension strap (510*a* or 510*b*) from disengaging during use of the tandem hammock system—such disengagement requiring, as described above, a user applying force to deform resilient gate section (210*a* or 210*b*) to temporarily open the closure.

Figure 4:
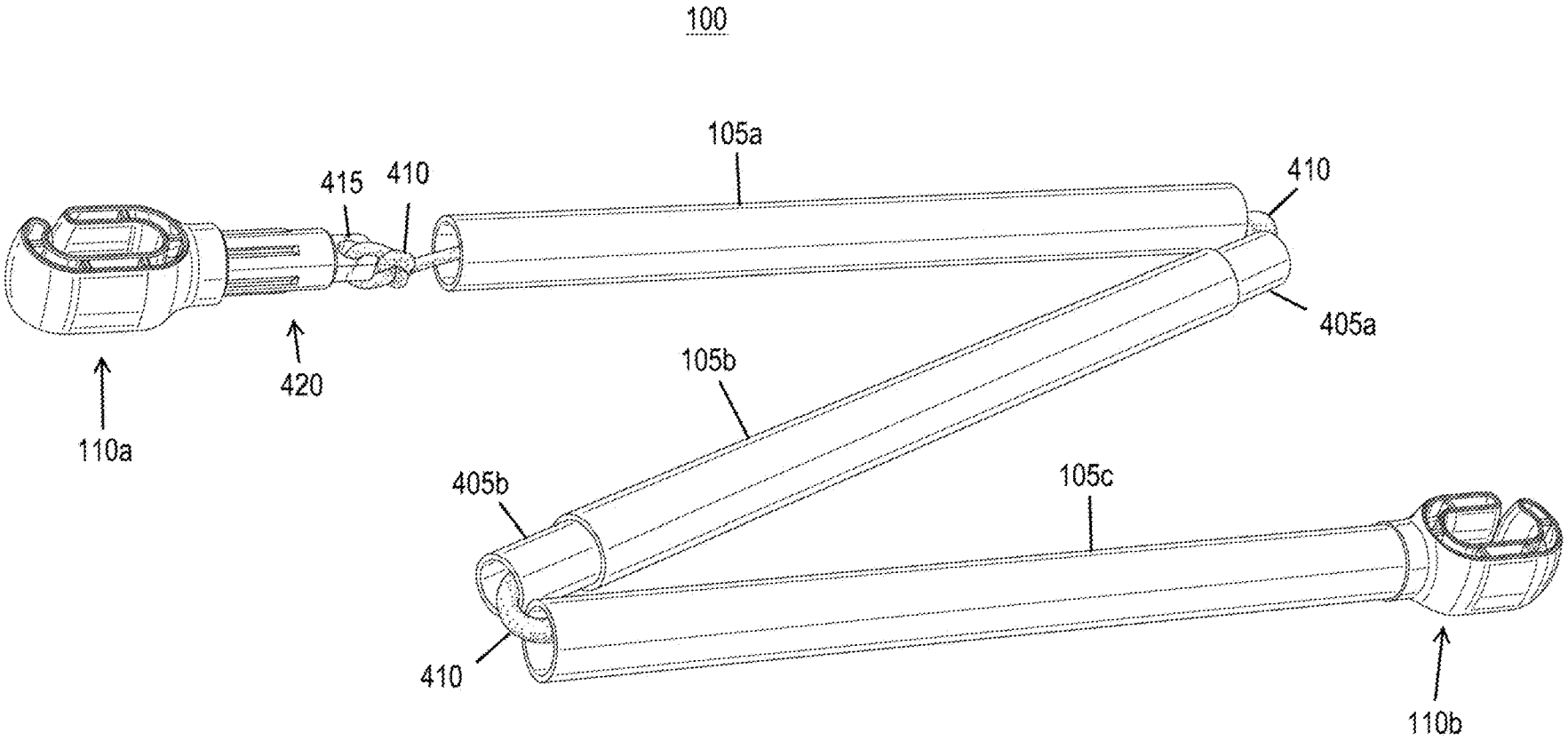
FIG. 4 is a perspective view of the tandem hammock bar of FIG. 1 in a collapsed configuration.

FIG. 4 illustrates bar 100 in a disassembled, collapsed configuration. As shown in FIG. 4, sections 105*a*, 105*b*, and 105*c* are hollow cylinders that can be detached from one another, where middle section 105*b* includes portions 405*a* and 405*b* on its two ends that have smaller outer circumferences for fitting with the inner circumferences on respective ends of sections 105*a* and 105*c*. In addition, fastening elements 110*a* and 110*b* are tethered to each other with an elastic rope 410. As illustrated in FIG. 4, elastic rope 410 is tied to loop 415 on an insertion end 420 of fastening element 110*a* that is inserted into section 105*a* on an opposite end to section 105*b* while bar 100 is assembled, as shown in FIGS. 1-3. Elastic rope 410 is tied on an opposite end to fastening element 110*b* in a similar manner. Accordingly, elastic rope 410 tied to fastening elements 110*a* and 110*b* exerts an inward force so that sections 105*a*, 105*b*, and 105*c* are held together while bar 100 is assembled—in other words, with portion 405*a* of section 105*b* inserted into one end of section 105*a*, insertion end 420 of fastening element 110*a* inserted into an opposite end of section 105*a*, portion 405*b* of section 105*b* inserted into one end of section 105*c*, and an insertion end (not shown) of fastening element 110*b* inserted into an opposite end of section 105*c*. The inward force is sufficient for holding bar 100 (i.e., bars 100*a* and 100*b* shown in FIG. 5) together while it is assembled but the elasticity of rope 410 would allow a user to disassemble and collapse bar 100 without undue effort. Additionally, as illustrated in FIG. 4, sections 105*a*, 105*b*, 105*c* and fastening elements 110*a*, 110*b* remain tethered together in the disassembled, collapsed configuration so that they can be easily reassembled. With its reduced length of approximately one of the sections 105*c*, 105*b*, and 105*c* and a fastening element 110*a* or 110*b*, bar 100 can be conveniently stored in the disassembled, collapsed configuration.

The tandem hammock system shown in FIG. 5 may be assembled by following the steps set forth in FIGS. 6-9.

Figure 6:
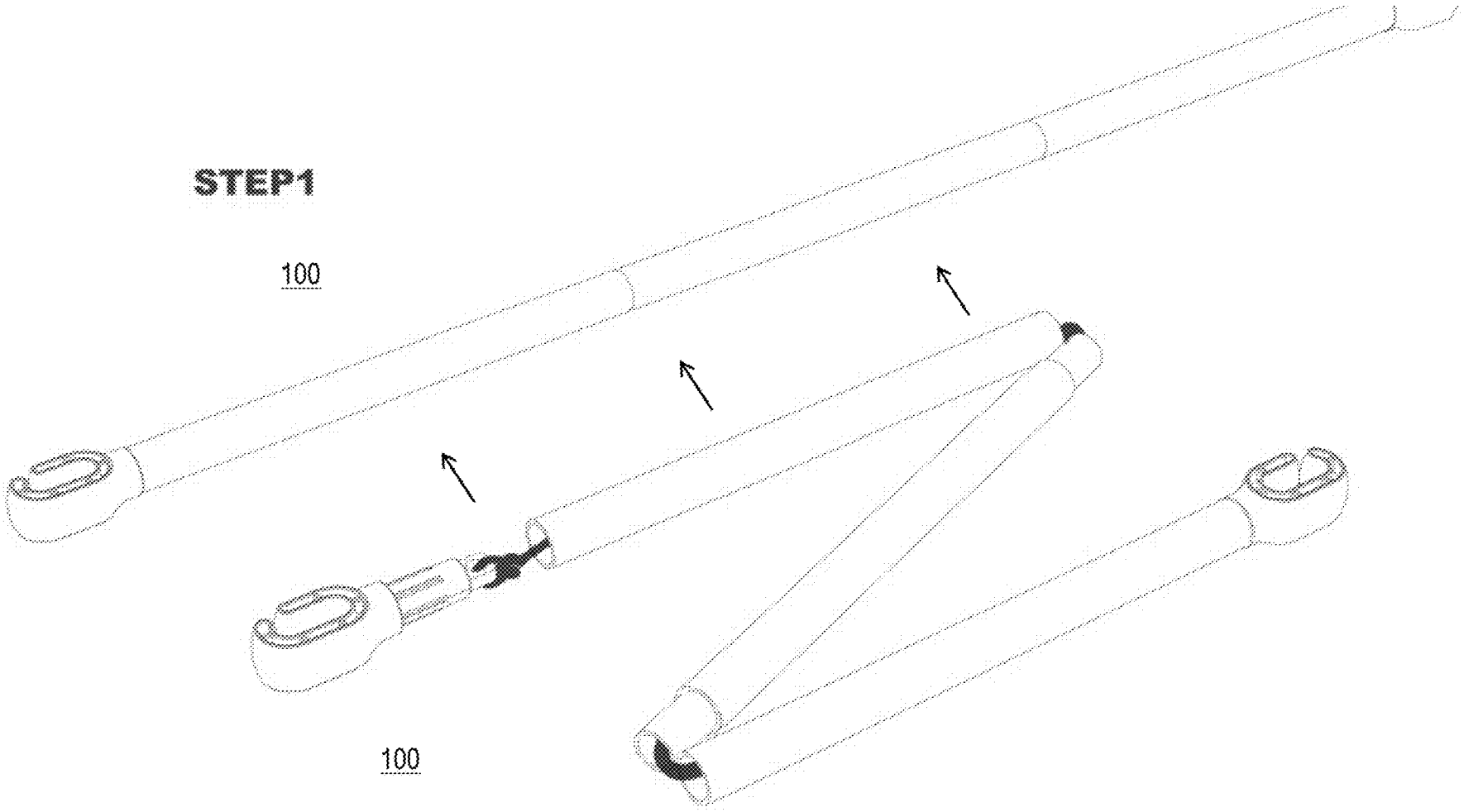
FIG. 6 is a perspective view of an embodiment of a tandem hammock bar for use with the disclosed tandem hammock system and method, in both extended and collapsed configurations.
Figure 7:
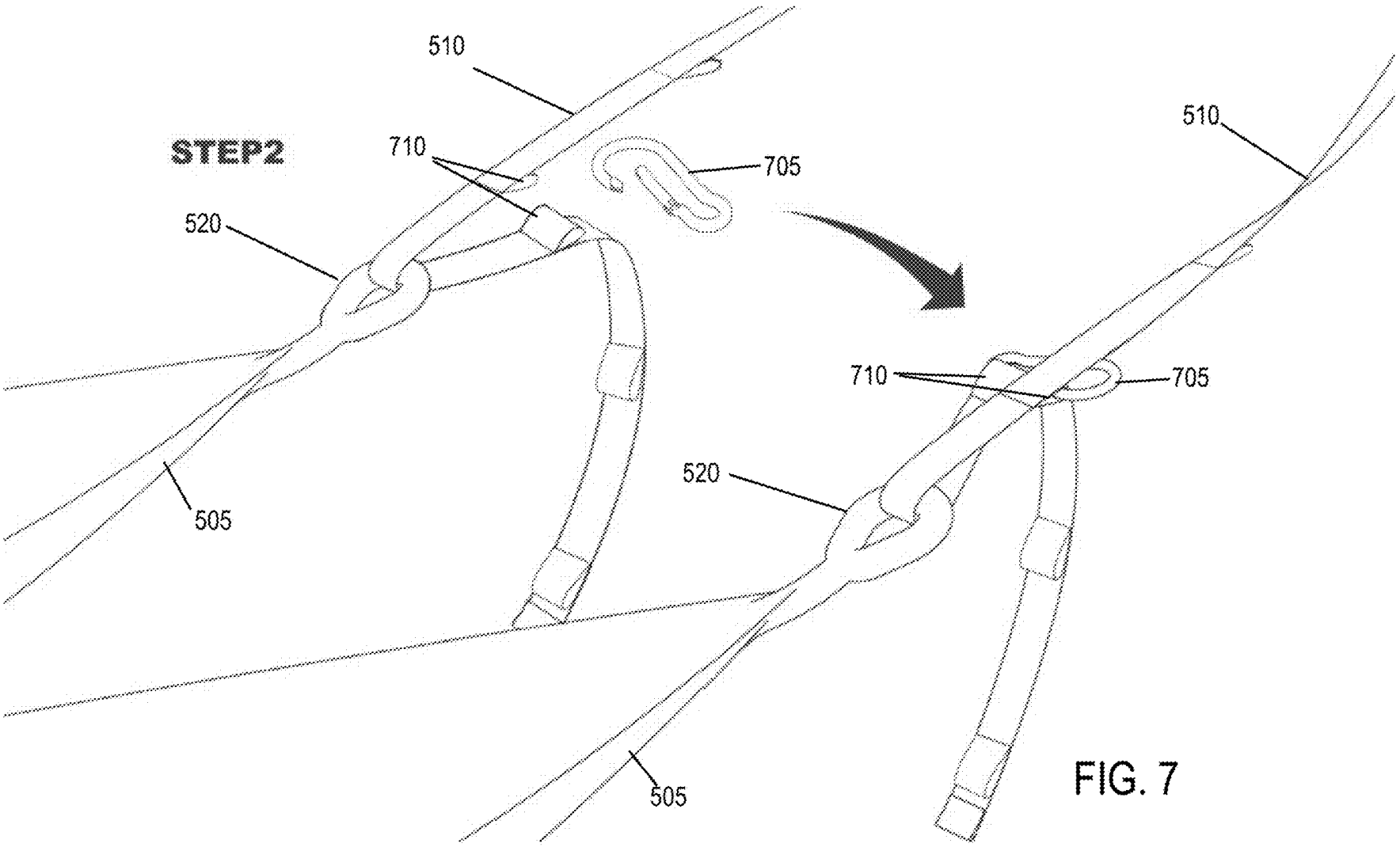
FIGS. 7-9 are perspective views of the steps for hanging the tandem hammock system according to an exemplary embodiment of the present invention.

With reference to FIG. 6, as step 1, the user begins by extending the tandem hammock bars 100*a* and 100*b*, as described above with reference to FIGS. 1-3. The bars may be configured to break-down into multiple segments to facilitate transport and storage, as described above with reference to FIG. 4. As shown in FIG. 7, as step 2, the user then attaches the hammock suspension straps 510(*a* and *b*) to two trees (515*a* and 515*b* shown in FIG. 5), loops straps 510(*a* and *b*) through respective loops 520(*a, b, c*, and *d*) of hammocks 505(*a* and *b*), and secures straps 510(*a* and *b*) using a carabiner 705 or other fastening device. As illustrated in FIG. 7, each strap 510(*a* and *b*) incorporates a plurality of loops 710 that are spaced apart at regular distances so that carabiner 705 can fasten adjacent loops 710 on strap 510(*a* and *b*) while strap 510(*a* and *b*) is looped through loop 520(*a, b, c*, and *d*) of hammock 505(*a* and *b*) in order to fasten strap 510(*a* and *b*) to hammock 505(*a* and *b*). In embodiments, alternative manners of fastening strap 510 to hammock 505 may be used.

Figure 8:
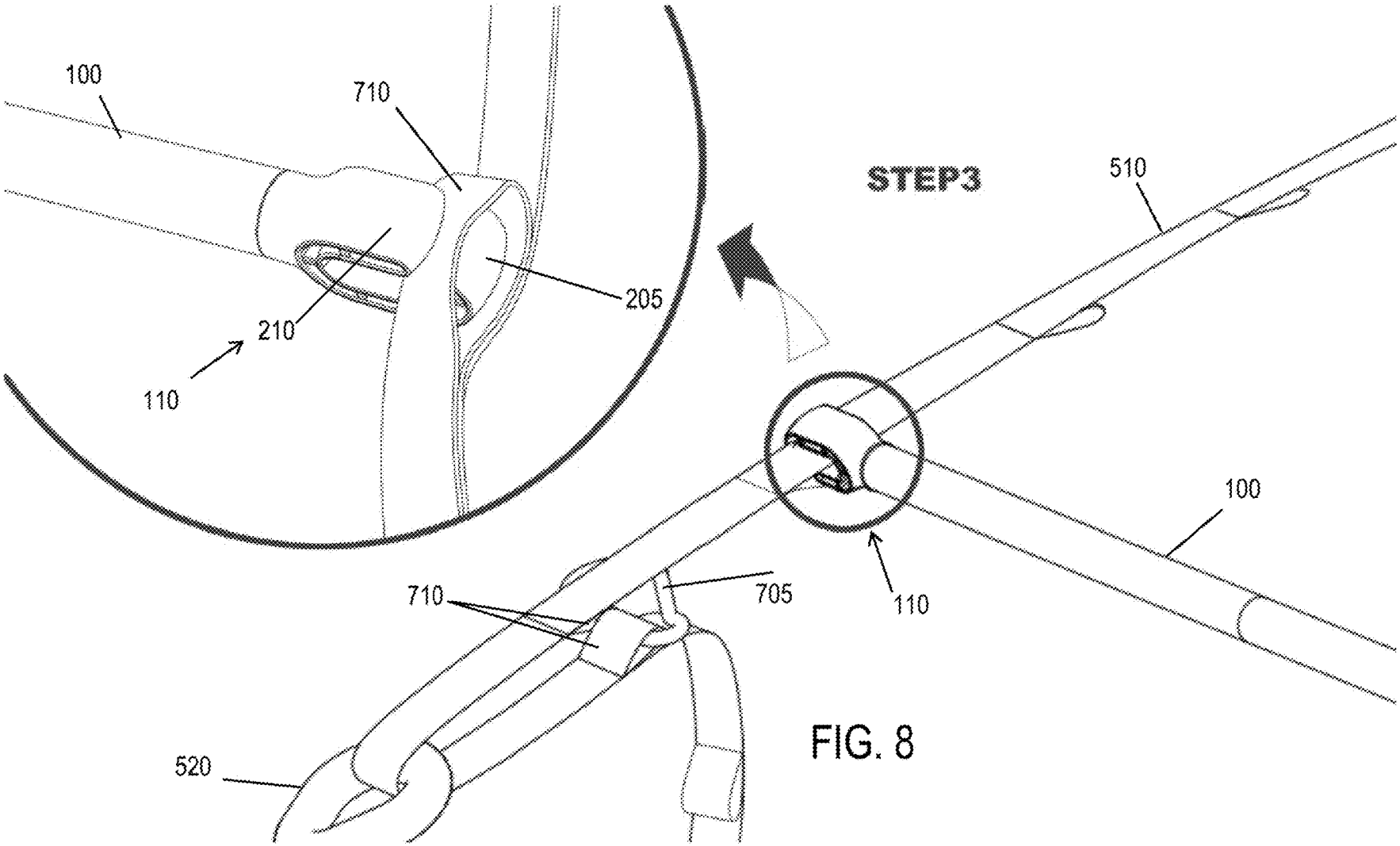

Next, as shown in FIG. 8, as step 3, the user then secures the tandem hammock bars 100(*a* and *b*) to the loops 710 of the hammock suspension straps 510(*a* and *b*), thus, maintaining the pair of hammocks 505(*a* and *b*) at a fixed distance relative to one another. According to an exemplary embodiment of the invention, bars 100(*a* and *b*) are fixed to the loops 710 that are adjacent to the loops 710 through which carabiners 705 are attached for forming the fastening loops of respective straps 510(*a* and *b*) for fastening to hammocks 505(*a* and *b*)(via loops 520 thereof). As illustrated in the zoomed in section of FIG. 8 and with reference to FIGS. 2 and 3, the loops 710 and/or straps 510(*a* and *b*) can be slid through openings 215(*a* and *b*) of fastening element 110(*a* and *b*) by a slight displacement of section 205(*a* and *b*) and/or 210(*a* and *b*) that thereby forms a temporary opening at closure 305(*a* and *b*).

Figure 9:
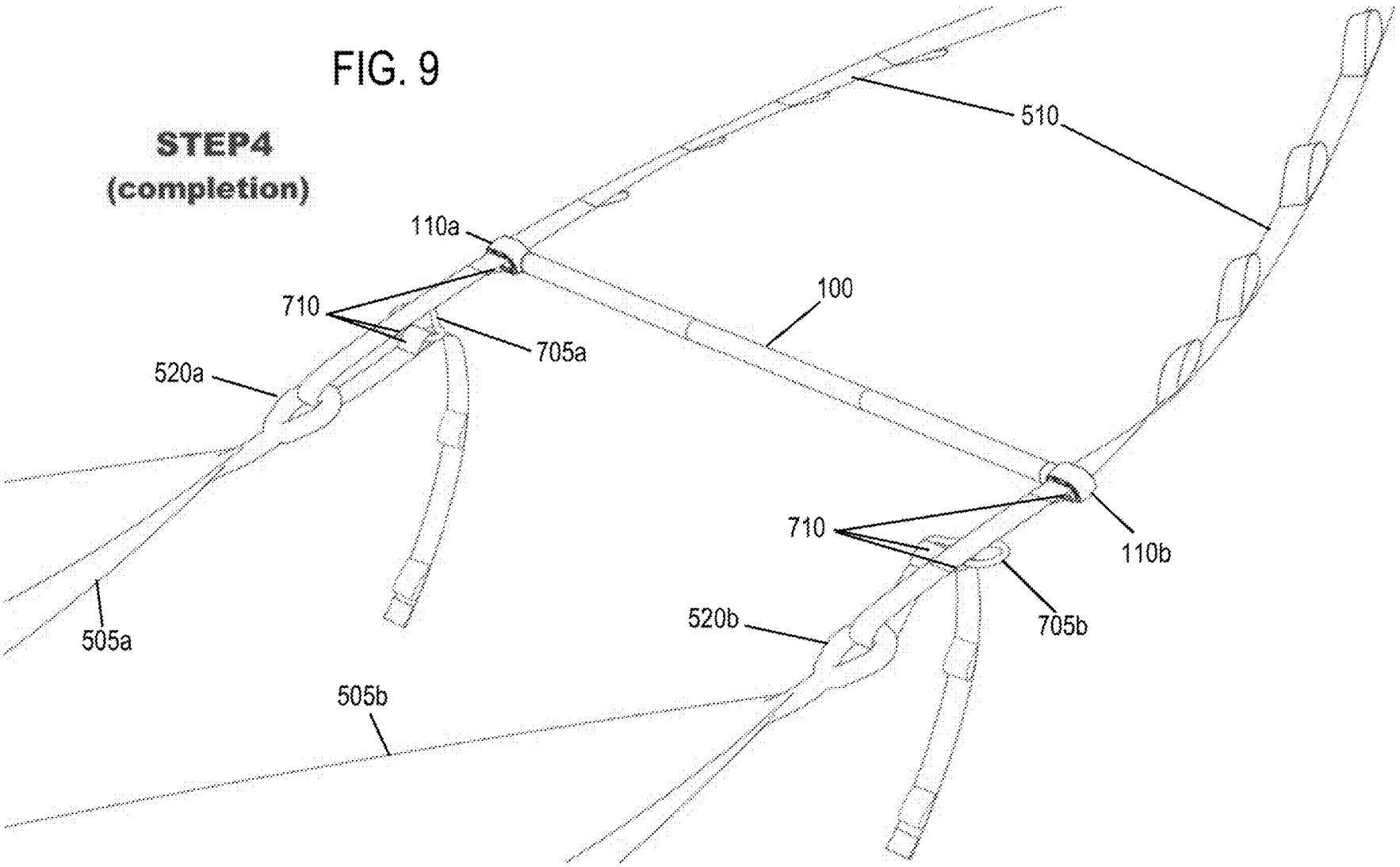

Once bars 100(*a* and *b*) are secured to the suspension straps 510(*a* and *b*), the tandem hammock system is completed. FIG. 9 illustrates this completion on one end of the fully assembled tandem hammock system. As shown in FIG. 9, hammocks 505*a* and 505*b* are fastened to suspension strap 510 by threading strap 510 through loops 520*a* and 520*b* of hammocks 505*a* and 505*b*, respectively, and fastening adjacent loops 710 on strap 510 together with carabiners 705*a* and 705*b*. Bar 100 is secured to strap 510 by securing fastening elements 110*a* and 110*b* to respective loops 710 that are adjacent to those secured by carabiners 705*a* and 705*b*, respectively. Accordingly, as described above, hammocks 505*a* and 505*b* are aligned and held at a predetermined distance by bar 100, with a similar arrangement on the opposite ends of hammock 505*a* and 505*b*.

While particular embodiments of the present disclosure have been shown and described in detail, it would be obvious to those skilled in the art that various modifications and improvements thereon may be made without departing from the spirit and scope of the disclosure. It is therefore intended to cover in the appended claims all such modifications and improvements that are within the scope of this disclosure.

The invention claimed is:

1. A tandem hammock assembly, comprising:

a plurality of hammocks coupled to one another by at least two straps, each of the at least two straps being fastened to respective ends of the plurality of hammocks; and at least two elongate bars each comprising two fastening elements on respective ends, the fastening elements being adapted to detachably fasten to respective ones of the at least two straps, wherein the at least two straps are each adapted to be detachably fixed to a respective anchoring structure and further wherein each of the at least two straps comprises a plurality of evenly spaced apart strap loops along a length of each strap and each of the at least two straps is detachably fastened to one of the respective ends of the plurality of hammocks by forming a loop through a hammock end loop on the one of the respective ends of the plurality of hammocks and detachably fastening two adjacent ones of the plurality of strap loops together.

2. The tandem hammock assembly of claim 1, wherein the at least two elongate bars are equal in length.

3. The tandem hammock assembly of claim 1, wherein each of the two elongate bars comprises a plurality of sections that are detachable from one another and the two fastening elements.

4. The tandem hammock assembly of claim 3, wherein the two fastening elements are tethered to each other by an elastic rope.

5. A tandem hammock assembly, comprising:

a plurality of hammocks coupled to one another by at least two straps, each of the at least two straps being fastened to respective ends of the plurality of hammocks; and at least two elongate bars each comprising two fastening elements on respective ends, the fastening elements being adapted to detachably fasten to respective ones of the at least two straps, wherein the at least two straps are each adapted to be detachably fixed to a respective anchoring structure, and further wherein each of the at least two straps comprises a plurality of strap loops that are evenly spaced apart along a length of the each strap and each of the at least two straps is detachably fastened to one of the respective ends of the plurality of hammocks by forming a loop through a hammock end loop on the one of the respective ends of the plurality of hammocks and detachably fastening two adjacent ones of the plurality strap loops together.

6. The tandem hammock assembly of claim 5, wherein one of the fastening elements is detachably fixed to another one of the plurality of strap loops that is adjacent to one of the two fastened adjacent strap loops.

* * * * *